United States Patent [19]

Theurer

[11] 3,943,857

[45] Mar. 16, 1976

[54] TRACK SURFACING

[75] Inventor: Josef Theurer, Vienna, Austria

[73] Assignee: Franz Plasser Bahnbaumaschinen Industriegesellschaft MBH, Vienna, Austria

[22] Filed: July 18, 1974

[21] Appl. No.: 489,938

[30] Foreign Application Priority Data

Sept. 2, 1973 Austria ..... 8174/73

[52] U.S. Cl. ..... 104/7 R; 104/12

[51] Int. Cl.[2] ..... E01B 27/16

[58] Field of Search ..... 104/7 R, 8, 12, 7

[56] References Cited

UNITED STATES PATENTS

| | | | |
|---|---|---|---|
| 3,274,952 | 9/1966 | Fekete | 104/7 R |
| 3,796,160 | 3/1974 | Waters et al. | 104/7 R |
| 3,811,382 | 5/1974 | Buchter et al. | 104/7 R |

*Primary Examiner*—M. H. Wood, Jr.
*Assistant Examiner*—Richard A. Bertsch
*Attorney, Agent, or Firm*—Kurt Kelman

[57] ABSTRACT

In track surfacing, a downward thrust is exerted upon the abutting ends of the adjacent rails at a rail joint, the abutting rail ends are simultaneously upwardly bent above the correct track level against the downward thrust and the ballast is tamped under the ties in the region of the joint. For this purpose, control means is arranged to discontinue actuation of the operating means of the track level correction means used to bend the abutting rail ends upwardly when the rail joint level has reached a set limit.

15 Claims, 3 Drawing Figures

TRACK SURFACING

The present invention relates to improvements in track surfacing, and more particularly to a method and apparatus for correcting the level of a track and upwardly bending the rail joints of the track.

As is well known, the rail joints are the first sections of a corrected track to sag. As the ties under the joints settle below the corrected level, the abutting rail ends fastened to the ties are deformed, i.e. they are bent downwardly. It has, therefore, been proposed to work on the rail joints one or two weeks before a given track section is surfaced. This preparatory work on the rail joints involves lifting them above the desired corrected level of the track section to be obtained by the subsequent surfacing operation and to tamp ballast under the lifted joints by a special rail joint tamping machine. In a suspended joint, for instance in a welded track rail, the two ties adjacent the rail joint are tamped to lift the downwardly bent abutting rail ends above the desired corrected track level and to fix them at that superelevated level. The subsequent train traffic will then eventually align the superelevated joints with the level of the remainder of the corrected track.

None of the conventional methods has produced a long lasting accurate level of the abutting rail ends of a rail joint. The depression of rail joints is caused, for example, by very dirty ballast providing only a relatively weak support for the track rail joints. At such points, the abutting rail ends of the joint rapidly sink and cannot be held in alignment by the loads to which passing trains may subject them. These misalignments of the track joints impair the comfort and even the safety of the trains riding such tracks. Furthermore, the double work on the track involved in the joint pretreatment of the prior art is uneconomical and fails to obtain the accuracy of track levels desired for present-day train speeds.

While combined rail joint lifting and tamping machines are known and improve the economy of the track correction operation, it has not been possible with these machines to correct the bent abutting rail ends at the rail joints during the surfacing operation which involves the superelevation of the rail ends above a corrected level determined by a reference system.

Whether the joints are worked on separately or during the surfacing operation, as outlined hereinabove, if they are badly deformed, the fishplates connecting the abutting rail ends will have to be straightened out or replaced before the joints can be leveled.

In the leveling and tamping of track, it has also been proposed to prevent an upward arching of the track in the region of the tamping unit. In this operation, no part of the track is forcibly bent above the corrected track level, and it cannot overcome the disadvantages connected with leveling of rail joints outlined hereinabove.

It is the primary object of this invention to provide a method and apparatus for the rapid, economical and accurate leveling of abutting rail ends at rail joints.

It is another object of the invention to provide a continuous leveling of rail joints during the correction and tamping of the entire track section of which the rail joints form a part.

The above and other advantages and objects of the present invention are accomplished in a method of surfacing a track, wherein the track has a controlled corrected level determined by a reference system, by exerting a downward thrust on the abutting ends of the adjacent ends at the rail joints while upwardly bending the abutting rail ends above the controlled level against the downward thrust, controlling the upward bending stroke to limit the same, and tamping ballast under the ties in the region of the joints.

This method has the advantage that the abutting rail ends at the rail joints are bent upwardly above the corrected track level in one operation and all the ties whose level is changed by the bending of the rail ends may be tamped at the same time. This provides a secure support for the rail joints and considerably improves the ability of the track to sustain high-speed train traffic. The method has the further advantage of making it possible to work on rail joints during relatively brief train traffic intervals. Furthermore, the resistance moment of the upwardly bent rail ends, combined with the tamped ballast thereunder and possibly a superelevation of the ties in the region of the joint beyond the level of the remainder of the track, counteracts the loads and impact of the train wheels as they run from one rail end to the abutting rail end, i.e. the depression of the track rails at their joints.

The joints are rapidly and accurately leveled and this, in turn, expedites the surfacing of the entire track section. Since the accurate and secure leveling of the joints makes it possible to extend the time intervals for correction and also saves such extra operations as the manual replacement of fishplates, which are bent with the rail ends according to the invention, the method is very economical. Furthermore, because the abutting rail ends are bent against a counter-thrust, the extent of bending is limited and may be accurately controlled.

The invention also provides a mobile track surfacing apparatus comprising track raising means in the region of the abutting rail ends for bending the rail ends upwardly, control means for actuating the track raising means and for discontinuing the actuation after the abuting rail ends have been bent upwardly above a controlled track level. The control means includes limit means associated with each rail for delimiting the upward bend of the abutting rail ends, and downward thrust means are spaced from the track raising means in the region of at least one of the abutting rail ends. In such an apparatus, this invention provides the improvement of the track level correction means comprising track raising tool means arranged to engage at least one of the abutting rail ends for bending the rail ends in the region of the joints above the corrected rail level. The control means is arranged to discontinue actuation of the operating means of the track level correction means when the track has reached the limit means, and the downward thrust means is arranged spaced from the track raising tool means in the region of at least one of the abutting rail ends.

Such an apparatus has a relatively simple structure and, since conventional track tampers usually have reference-controlled tamping units and track raising tools arranged close to an undercarriage, relatively few and inexpensive changes in such conventional machines suffice to adapt them for the practice of the present invention. With the apparatus of this invention, it is possible to obtain an even and accurate track level over a considerable length of track if the bending of the rail joints and preferably also the track lifting is accurately controlled. Such accurate control assures that abutting rail ends at the joints are bent upwardly to the desired extent above the desired correction track level and this is important because excess bending of the rail ends would endanger the saftey of the track and could lead to derailments. Furthermore, suitable selection of the location of the downward thrust means in the apparatus of the invention within the region of at least one of the rail ends makes it possible to impart the proper bend to the abutting rail ends at the joint. This selection depends on local conditions and may be adjusted to light or heavy rails so that the length of the rail ends to be bent may be accurately delimited. Experience has shown that this length usually extends over two ties at each side of the rail joint and this experimentally determined distance may be taken into account in the construction of the apparatus and the location of the thrust means therein.

The above and other objects, advantages and features of the present invention will become more apparent from the following detailed description of some now preferred embodiments thereof, taken in conjunction with the accompanying drawing wherein FIG. 1 is a schematic side elevational view of one embodiment of the apparatus of this invention;

Figure 1:
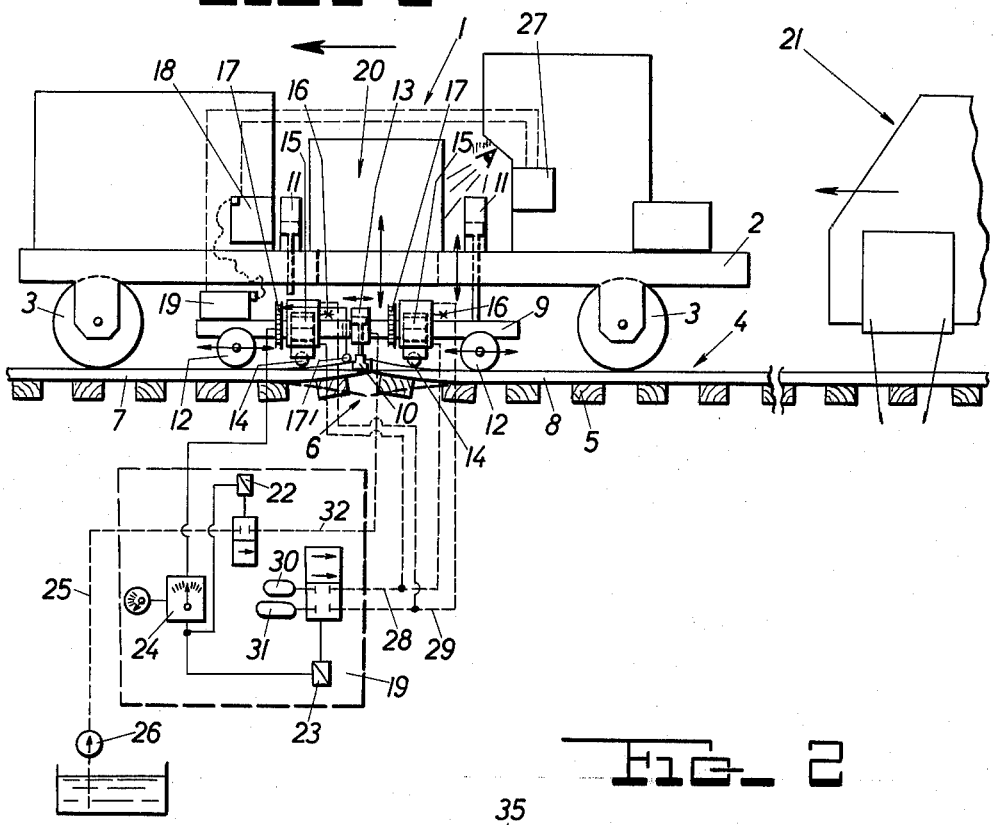

Referring now to the drawing which illustrates mobile track surfacing apparatus for correcting the level of track 4 consisting of two rails fastened to ties 5 resting on ballast (not shown), apparatus 1 of FIG. 1 comprises main frame 2 mounted on undercarriages 3, 3 for mobility on track 4. A so-called suspended rail joint 6 is formed by two abutting rail ends 7, 8 which are welded together, the joint being located between two adjacent ties 5.

The abutting rail ends at the joint are bent upwardly from the depressed position shown in broken lines to the desired position above the corrected track level shown in full lines by a track raising tool means mounted on frame 9, the illustrated tool means being a jack with rail engaging clamp 10. Frame 9 is mounted on apparatus frame 2 by means of jacks 11 so that it may be vertically adjusted and has two undercarriages, wheeled axles or rollers 12 for mobility on the track when the frame has been lowered into track engaging position. When desired, the entire frame may be lifted off the track by means of jacks 11.

The track raising tool means is mounted on frame 9 intermediate and preferably about centered between running gears 12, 12 and rail engaging clamp 10 may be constituted by any suitable type of rail engaging hooks or rollers mounted for engagement with, and disengagement from, the rail, or it may be a magnetic rail engaging device. For raising the abutting rail ends and bending them upwardly at the joint, the rail engaging clamp is affixed to the piston rod of pressure fluid operated jack 13 which is vertically movable. The illustrated thrust means exerting a downward pressure on abutting rail ends 7 and 8 consists of running gears 12, 12 mounted on frame 9 on either side of the track raising tool means. Rollers 14, 14 are affixed to pressure fluid operated jacks 15 for vertical movement in respect of frame 9 and they are shown in this embodiment to be fixable in an adjusted vertical position by a mechanical stop 16 arranged to hold the rollers in the adjusted vertical position. This arrangement of the rollers enables the upward bending of the rail ends to be accurately controlled and, since rollers 14, 14 are mounted on a mobile frame, they may be accurately positioned on the track and both rollers have the same support base. This makes it easy to control the vertical adjustment of the rollers. To control this vertical adjustment, graduated scale 17 is mounted on frame 9 and a cooperating pointer may be mounted on the rail engaging clamp to show the relative vertical movement between the clamp and the frame and, as illustrated, sensor 17' is mounted on the rail for upward movement therewith and this movement may be read on scale 17 with which sensor 17' cooperates.

In this embodiment, frame 9 with vertically movable rollers 14, 14 and scale 17 with cooperating sensor 17' serve as reference determining the actual level of the track and the extent of the upward bend of the abutting rail ends at the joint. Scale 17 is a suitable transducer, such as a slip resistance or transformer, converting the vertical movement of sensor 17' into a corresponding signal.

Pressure fluid operated jacks 11, 13, 15 are arranged in a hydraulic fluid circuit including hydraulic fluid delivery system 18 mounted on main frame 2 of track surfacing apparatus 1. Track raising tool means 10, 13 constitute track level correction means for lifting the track to a corrected level and for bending the abutting rail ends at joint 6 above the corrected level, and the hydraulic fluid circuit provides means for operating jacks 13 and 15 of the track level correction means including rollers 14, 14 which constitute track correction limit means. Control means 19 actuates the operating means by controlling the delivery of hydraulic fluid to jacks 13 and 15, a simplified circuit diagram of control 19 being shown in FIG. 1.

It should be noted that the upward bending of the rail joint is shown to an exaggerated scale in all figures of the drawing. In actual practice, the average upward bend of the abutting rail ends of main tracks is about 3 to 5mm on a measuring base of 1.5 m while it may reach up to about 10 mm in branch tracks. The acceptable tolerance for depressions at rail joints of a main track is less than 1 mm.

As schematically shown in FIG. 1, track surfacing apparatus 1 may also carry various track maintenance tools 20, such as screwdrivers, oilers, spike drivers or the like. Also shown in this figure is track tamping and leveling machine 21 coupled to track surfacing apparatus 1 for common movement therewith in the working direction indicated by the horizontal arrows so that the entire track section may be leveled and tamped simultaneously with the work on the rail joints, the latter preceding the former in the working direction.

The details of control 19 and the entire operation of surfacing apparatus 1, which is responsive thereto, will now be described.

Control 19 comprises respective control elements 22, 23 for controlling delivery of hydraulic fluid to jacks 13 and 15, respectively, the illustrated control elements consisting of solenoid valves in the hydraulic fluid circuit so as to control the vertical movement or position of rail clamp 10 and rollers 14. These valves are actuated by instrument 24 forming part of the control. The hydraulic fluid circuit comprises a hydraulic fluid sump and fluid delivery conduit 25, constant speed pump 26 in conduit 25 delivering the fluid from the sump to the jacks, the control being arranged in the conduit and the sump and pump being mounted on main frame 2 at 18.

Instrument 24 for actuating jacks 13 and 15 may be remote controlled by an operator by mounting switch arrangement 27 at the operator's console.

Transducer 17, 17′ is electrically connected to instrument 24 to transmit a signal corresponding to the track level sensed by sensor 17′ at one of the abutting rail ends to the instrument. When apparatus 1 reaches a position at rail joint 6 and the two abutting rail ends 7, 8 are in the deformed position shown in broken lines, i.e. they have been depressed, the signal from transducer 17, 17′ will cause instrument 24 to actuate valve 23. Solenoid valve 23 is mounted in hydraulic fluid delivery branch conduits 28, 29 connecting fluid storage tankes 30, 31 with jacks 15, 15. Actuation of valve 23 places the fluid storage tanks into communication with their associated jacks, the hydraulic fluid being stored in tank 31 at a higher pressure than in tank 30. The resultant supply of hydraulic fluid to the jacks moves rollers 14, 14 into engagement with rails ends 7, 8 and senses the vertical position of the rail ends in respect to the reference constituted by frame 9.

The deformation of the rail joint, i.e. its vertical deviation of the track level, is converted by transducer 17, 17′ into a corresponding signal, i.e. a measuring voltage or current transmitted to instrument 24 where it is compared to a value set to indicate the desired level. The signal from the transducer, which corresponds to the extent of the depression at joint 6 sensed by sensor 17′, also causes instrument 24 to actuate control element 22. Actuation of valve 22 places the hydraulic fluid sump into communication with associated jack 13 through conduits 25 and 32 so as to move rail engaging clamp 10 upwardly and to bend rail ends 7, 8 into the position shown in full lines. Running gears 12 of frame 9 serve as thrust means to exert a counter or downward pressure on the rail ends while they are being bent upwardly by track raising tool 10, 13, the running gears also delimiting the length of the rail ends being bent.

The above-described control produces a high accuracy of the bending operation since the termination thereof as well as the control of the limiting means for the upward bending are related to common reference 9. Upward bending of the rail ends moves rollers 14, 14 and sensor 17′ upwardly, the relative movement of sensor 17′ in respect of scale 17 changing the control signal transmitted to instrument 24, causing closing of valves 22, 23 when the joint has been bent upwardly above the corrected level of the track. Afterwards, the upwardly bent rail joint is tamped by succeeding tamper 21. It is advantageous if surfacing apparatus 1 bends each succeeding rail joint immediately before the tamping in a continuously proceeding track tamping operation.

As shown by the double-headed arrows, running gears 12, 12 may be mounted for adjustment on frame 9 in the direction of track elongation, track raising tool 10, 13 being substantially centered between the running gears, with the rollers 14, 14 arranged between the track raising tool and a respective one of the running gears. With such an arrangement, the configuration of both rail ends adjoining the joint will be substantially the same so that the same conditions will prevail regardless of the direction of traffic. This is particularly advantageous where traffic in both directions is carried by a single track. The adjustability of the running gears, which serve as thrust means, is advantageous becuase a proper selection of their relative distance makes the apparatus adaptable to various types of rails. Heavier rails, for instance, require a larger spacing of the thrust means from each other than light rails.

Also, a motor may be mounted on frame 9 to make the apparatus for bending the rail ends at the joint self-propelled and movable on the track independently of apparatus 1.

The apparatus will be more readily adjustable to local conditions if the frame carrying the track level correction means and the thrust means is mounted on, or coupled to, apparatus frame 2 for adjustment in the direction of track elongation. This makes it possible to work only on the rail joints without raising adjoining sections of the track. The upward bending of the abutting rail ends may thus be strictly limited to a desired distance from the joint and lifting of the track section beyond the joint can be avoided. The adjustability of the frame carrying the track level correction means in relation to the main apparatus frame has the advantage of making it possible to tamp not only the tie at the joint but also the adjacent ties while the abutting rail ends at the joint are bent upwardly. This produces a particularly solid tie support in the region of the joint and thus improves the durability of the corrected track.

Figure 2:
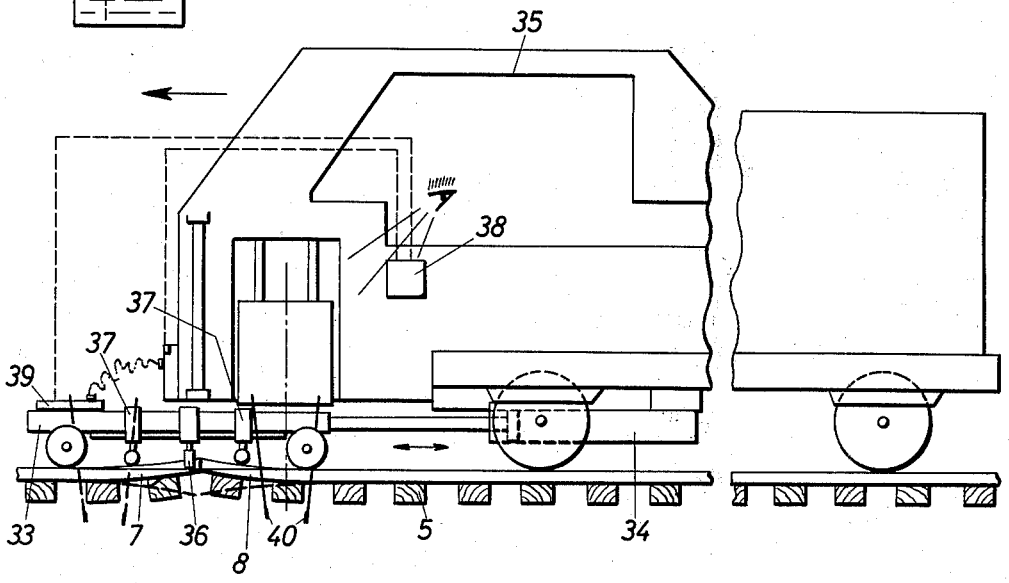
FIG. 2 is a like view of a second embodiment.

An apparatus of this type, with an adjustable frame carrying the track level correction means, is illustrated by way of example in FIG. 2. Frame 33, which is equivalent to frame 9 in FIG. 1, is coupled to the frame of any suitable or conventional mobile track tamping and leveling machine 35 by pressure fluid operated cylinder-and-piston coupling 34 so that frame 33 may be moved in the direction of track elongation in relation to machine 35. Similarly to the arrangement of FIG. 1, track raising tool 36 is mounted on the frame intermediate its two running gears to enable the abutting rail ends at the rail joint to be bent upwardly, frame 33 and rollers 37, 37 serving as a reference for the raising of tool 36. As hereinabove described in connection with the embodiment of FIG. 1, tool 36 is operated to bend the abutting rail ends upwardly until they are engaged by rollers 37, 37 during the advancement of the machine and the bending operation, the vertical position of the rollers having been preadjusted and fixed in the adjusted position. In this case, frame 33 and the two fixed rollers 37 serve as a reference, the rollers being pre-adjusted in their vertical position to provide the desired degree of bending, accurate values for the bending of the rail ends not being necessary in this surfacing operation. The operator at console 38 may control operating means 39 for the vertical adjustment of rollers 37, 37 and the vertical movement of track raising tool 36.

After abutting rail ends 7, 8 have been bent upwardly, ties 5 are tamped by tamping tool unit 40 of machine 35, the tamping tool unit being arranged behind the track raising tool in the working direction indicated by the horizontal arrow. During the tamping operation, hydraulically operated coupling 34 maintains tool 36 and rollers 37, 37 at the adjusted distance so as to assure an accurate tamping of the ties in the region of the rail joint and a solid support for the joint by the tamped ballast.

Figure 3:
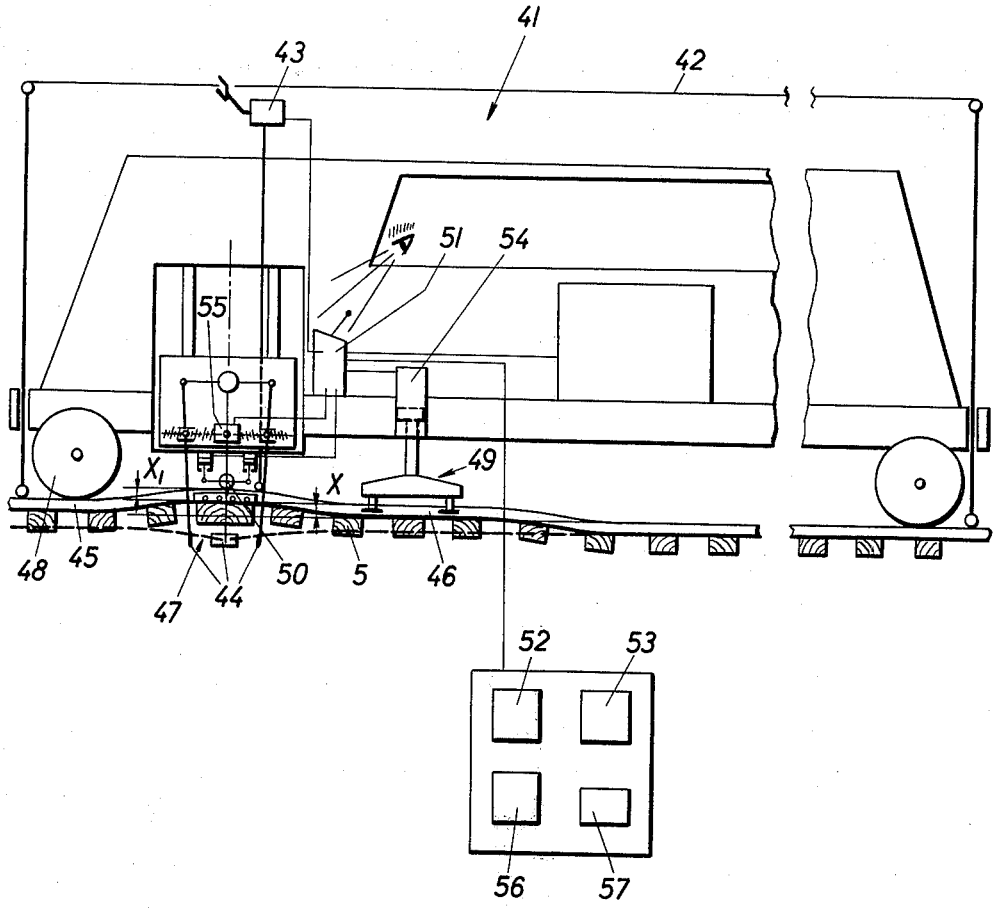
FIG. 3 is a like view of a third embodiment.

In the embodiment of FIG. 3, the track surfacing apparatus of the present invention is incorporated into a type of mobile track tamping and leveling machine 41 which operates with a tensioned wire 42 constituting the reference system determining the corrected track level. As is conventional in such machines and, therefore, not described in detail herein, such a reference system comprises transducer 43 cooperating with tensioned wire 42 to determine the actual track level in the region of tamping tool unit 44, the transducer being supported on abutting rail ends 45, 46 to indicate their level and converting this distance measurement in respect to wire 42 into a control signal, all in a well known manner. Contrary to the welded rails of FIGS. 1 and 2, joint 47 of abutting rail ends 45, 46 is formed by a fishplate connecting the rail ends and fastened to a double tie at the joint.

Control console 51 of the machine incorporates a control substantially equivalent to control 19 described in connection with the embodiment of FIG. 1. Therefore, only essential parts of this control have been schematically shown in the circuit diagram of FIG. 3. Control elements 52, 53, which are equivalent to valves 22, 23 of control 19, actuate drive 54 for track raising tool 49 and drive 55 for the tamping tools of unit 44. Transducer 43 transmits its control signal corresponding to the measured track level to comparator device 56 associated with instrument 57 for setting the threshold of device 56.

One threshold of comparator device or gage 56 is set so that, when the track in the region of tamping unit 44 has reached the corrected level determined by reference wire 41, the device transmits a signal to the control element associated with drive 54 to hold track lifting unit 49 in the vertical position it has reached after the lifting stroke $x$ has been complated. If the track lifting unit is operated by a hydraulic jack, the control element may be a solenoid valve in the hydraulic fluid delivery conduit leading to the jack, closing of this valve holding the fluid in the jack cylinder chamber above the jack piston so that unit 49 is held in its vertical position. The second threshold of device 56 is set so that the device transmits a signal to the other control element associated with drive 55 to terminate the closing movement of the tamping tools and thus to end the upward pressure by the tamped ballast when the abutting rail ends have been bent upwardly above the corrected track level by additional stroke $x_1$. Again, if the reciprocable tamping tools are operated by a hydraulic drive, which may turn a threaded spindle reciprocably moving the tamping tools on rotation thereof, the associated control element may be a solenoid valve in the hydraulic fluid delivery conduit leading to drive 55, closing of the valve by the control signal terminating the drive actuation.

As shown in FIG. 3, the tamping tool unit is of the type wherein the tamping tools "encase" the end of each tie and the intersection of the rail and tie, i.e. unit 44 comprises pairs of reciprocable tamping tools arranged for immersion in the cribs adjacent the tie and a reciprocable tamping tool arranged for immersion in the ballast adjacent the tie end. Upward bending of the abutting rail ends from the position shown in broken lines to that shown in full lines by stroke $x_1$ is produced solely by tamping ballast under the double tie to which joint 47 is fastened, the track at this point being raised by the upward pressure of the tamped ballast. Rear axle 48 of machine 41 and track lifting unit 49 are so spaced in the direction of track elongation according to the invention that they engage the track rails in the region of abutting rail ends 45, 46. Thus, running gear 48 and unit 49, after it has been blocked in the vertical position of the corrected track level, serve as thrust means counteracting the upward bend of the rail joint. The bending of the rail joint is limited by roller 50. In this manner, only the deformed portion of the abutting rail ends is upwardly bent above the corrected track level, this rail joint bending operation proceeding very economically and accurately during the intermittent lifting and tamping of a track section during an otherwise conventional continuous track surfacing operation, the rail joint bending requiring a minimum of additional parts on the machine. Thus, where the rear axle of track tamping and leveling machine 41 and its track lifting unit are so spaced that they will engage the abutting ends of two adjacent rails forming a rail joint, the conventional control of the track tamping and lifting means only requires an additional control element to block or hold the track lifting unit at the corrected track level during the bending operation.

The embodiment of FIG. 3 is particularly useful on main lines since they require frequent track surfacing operations so that the rail joints usually are not too strongly deformed.

What is claimed is:

1. In a method of surfacing a track consisting of two rails fastened to ties, abutting ends of adjacent ones of the track rails forming rail joints, wherein the track has a controlled level, the steps of upwardly bending the abutting rail ends above the controlled track level while simultaneously exerting a downward thrust on the abutting rail ends, controlling the upward bending stroke to limit the same, and tamping ballast under the ties in the region of the upwardly bent rail joints to maintain them upwardly bent.

2. In the method of claim 1, the steps of lifting the abutting rail ends to bend the same upwardly and subsequently tamping the ballast.

3. In the method of claim 1, the steps of lifting the track to a corrected track level controlled by a reference and upwardly bending the abutting rail ends above the corrected track level.

4. In a mobile apparatus for surfacing a track consisting of two rails fastened to ties, abutting ends of adjacent ones of the track rails forming rail joints, the track having a controlled level:

1. track raising means in the region of the abutting rail ends for bending the rail ends upwardly,
2. control means for actuating the track raising means and for discontinuing the actuation after the abutting rail ends have been bent upwardly above the controlled track level, the control means including
   a. limit means for delimiting the upward bend of the abutting rail ends,
3. downward thrust means spaced from the track raising means in the region of at least one of the abutting rail ends, and
4. tamping means in said region for tamping ballast under the ties.

5. In the mobile track surfacing apparatus of claim 4, the limit means consisting essentially of vertically adjustable rail engaging abutment means and means for fixing the abutment means in a vertically adjusted position.

6. In the mobile track surfacing apparatus of claim 4, the tamping means being mounted behind the track raising means in the working direction of the apparatus.

7. In the mobile track surfacing apparatus of claim 4, a track lifting means for lifting the track to a corrected level, a reference system for determining the corrected track level, and means for actuating the track lifting means in controlled response to the reference system.

8. In the mobile track surfacing apparatus of claim 4, a reference for determining the upward bend of the abutting rail ends, a transducer cooperating with the reference system and transmitting a control signal to the control means, the control means including a control circuit comprising the transducer, a control device receiving the control signal from the transducer, and control elements operated by the control device for discontinuing the actuation of the track raising means and operating the limit means.

9. In a mobile apparatus for surfacing a track consisting of two rails fastened to ties, abutting ends of adjacent ones of the track rails forming rail joints, the track having a controlled level:

1. track raising means in the region of the abutting rail ends for bending the rail ends upwardly,
2. control means for actuating the track raising means and for discontinuing the actuation after the abutting rail ends have been bent upwardly above the controlled track level, the control means including
   a. limit means for delimiting the upward bend of the abutting rail ends,
3. downward thrust means spaced from the track raising means in the region of at least one of the abutting rail ends,
   a. the downward thrust means including a frame bridging a respective one of the rail joints and running gears mounted on the frame and imparting a downward thrust to the abutting rail ends, and
4. tamping means for tamping ballast under the ties.

10. In the mobile track surfacing apparatus of claim 9, a main apparatus frame mounting the tamping means, and means for coupling the rail joint bridging frame to the main apparatus frame, the coupling being adjustable to change the distance of the running gears from the main apparatus frame in the direction of track elongation.

11. In the mobile track surfacing apparatus of claim 9, the limit means consisting of two vertically adjustable roller abutments respectively engaging a respective one of the abutting rail ends and means for fixing the roller abutments in a vertically adjusted position, the roller abutments being mounted on the frame intermediate the running gears and the track raising means.

12. In the mobile track surfacing apparatus of claim 9, a pair of the running gears mounted for adjustment in the direction of track elongation on the frame.

13. In the mobile track surfacing apparatus of claim 9, the frame being self-propelled.

14. In the mobile track surfacing apparatus of claim 9, a transducer cooperating with the reference system and transmitting a control signal to the control device and an instrument for adjusting the threshold of the control device to produce the first and second outputs.

15. In a mobile apparatus for surfacing a track consisting of two rails fastened to ties, abutting ends of adjacent ones of the track rails forming rail joints, the track having a controlled level:

1. track raising means in the region of the abutting rail ends for bending the rail ends upwardly,
2. control means for actuating the track raising means and for discontinuing the actuation after the abutting rail ends have been bent upwardly above the controlled track level, the control means including
   a. limit means for delimiting the upward bend of the abutting rail ends,
3. downward thrust means spaced from the track raising means in the region of at least one of the abutting rail ends,
4. tamping means for tamping ballast under the ties,
   a. the tamping means constituting the track raising means in the region of the abutting rail ends for bending the rail ends upwardly,
5. a track lifting means for lifting the track to a corrected level,
6. a reference system for determining the corrected track level,
7. means for actuating the track lifting means in controlled response to the reference system,
8. a main apparatus frame carrying the track lifting means and the ballast tamping means, and having a running gear spaced from the tamping means a relatively short distance so as to engage one of the abutting rail ends when the tamping means is substantially centered over a respective one of the rail joints and the track lifting means being spaced from the tamping means a relatively short distance so as to engage the other abutting rail end when the tamping means is so centered, and
9. the control means comprising a first control element blocking the track lifting means in the vertical position assumed when the track lifting means has lifted the track to the corrected level, the running gear and the blocked track lifting means constituting the downward thrust means, a second control element discontinuing operation of the tamping means to terminate upward bending of the abutting rail ends against the downward pressure of the thrust means, and a control device connected to the first and second control elements, a first output of the control device operating the first control element to block the track lifting means at the corrected track level and a second output of the control device operating the second control element to discontinue operation of the tamping means above said level.

* * * * *